US007066846B2

(12) United States Patent
Horkan

(10) Patent No.: US 7,066,846 B2
(45) Date of Patent: Jun. 27, 2006

(54) FOOTBALL AND SOCCER KICKING TRAINING AID

(76) Inventor: Noel P. Horkan, 1037 Washington Green, New Windsor, NY (US) 12558

( * ) Notice: Subject to any disclaimer, the term of this patent is extended or adjusted under 35 U.S.C. 154(b) by 0 days.

(21) Appl. No.: 10/912,797

(22) Filed: Aug. 6, 2004

(65) Prior Publication Data

US 2006/0030434 A1 Feb. 9, 2006

(51) Int. Cl.
*A63B 69/00* (2006.01)
*F41B 3/04* (2006.01)

(52) U.S. Cl. ..... 473/438; 473/419; 124/7

(58) Field of Classification Search ..... 473/422, 473/438, 419, 420, 470; 273/317.5; 124/16, 124/17, 7

See application file for complete search history.

(56) References Cited

U.S. PATENT DOCUMENTS 2,767,985 A * 10/1956 Maxcey, Jr. et al. ..... 473/438
3,399,892 A * 9/1968 Jurkiewicz ..... 473/438
4,460,173 A * 7/1984 Dumas ..... 473/419
4,511,141 A * 4/1985 Dumas ..... 473/419
4,860,717 A * 8/1989 Powell et al. ..... 124/7
4,906,001 A * 3/1990 Vaughn ..... 473/438
6,050,906 A * 4/2000 Stout et al. ..... 473/438
6,129,076 A * 10/2000 Powell et al. ..... 124/7
6,715,477 B1 * 4/2004 Gilman ..... 124/16

* cited by examiner

*Primary Examiner*—Mitra Aryanpour

(57) ABSTRACT

A portable football and soccer kicking training aid which holds and kicks a football or soccer ball in a trajectory, and with a force, simulating a ball kicked by a trained player. The training device is used by coaches in controlled practice sessions, to train and evaluate defensive and offensive lines and backs, and other players, in their response to kicked balls. The device provides repeated, reproducible kicked balls without requiring trained kickers to perform these routine functions or exposing them to injury. Optional, replaceable kicking shoes and other components provide alternate trajectories and forces. The device is readily portable and does not require fuel or connection to a power source.

17 Claims, 5 Drawing Sheets

FOOTBALL AND SOCCER KICKING TRAINING AID

BACKGROUND OF THE INVENTION

This invention relates to a training aid and, more particularly, to a device which kicks a football or soccer ball, and which assists in teaching a player to correctly block or otherwise defend against a kicked football or soccer ball, or to respond to a kicked ball.

The effective defense against a kicked football or soccer ball is not always readily learned. Balls kicked by players vary in trajectory and force, introducing an undesirable variability into the training experience. Further, repeated kicks by a player tire the player, decrease the precision of the ball's trajectory and speed, and increase the opportunity for injuries. The specialization of football players and teams increases the importance of defensive and offensive lines and backs being trained separately in specific techniques, and in kickers being trained separately in their specific skills.

The effective evaluation of players by coaches also requires observation of players' responses to repeated, realistic but controlled situations.

Thus, the correct training for effective defensive and offensive techniques regarding a kicked football or soccer ball, and the evaluation of personnel, would be enhanced by the availability of a device which reproducibly projected a football or soccer ball in the trajectory and with the force corresponding to a kicked ball. Further, there is a need for such a device that is portable, and does not require power from a fixed source.

Accordingly, it is desirable to present a device which kicks a football or soccer ball in a trajectory and with a force corresponding to a ball as kicked by a player.

Known prior art devices have not addressed the above problems. Various patents disclose devices and complex apparatus designed to hold footballs or soccer balls for kicking, or to project footballs in a trajectory corresponding to a thrown football, in a flat trajectory from shoulder height. Such devices and apparatus are aimed at training of kickers or of pass receivers and defenders, not of the players defending against, or responding to, a kicked football or soccer ball. (U.S. Pat. No. 4,477,077; U.S. Pat. No. 4,711,043; U.S. Pat. No. 4,807,880; U.S. Pat. No. 4,949,973; U.S. Pat. No. 5,435,572; U.S. Pat. No. 6,089,217).

BRIEF SUMMARY OF THE INVENTION

In response to the needs described I have invented a training aid in the form of a device which supports a standard football, or optionally a standard soccer ball, at a height and position approximating the height and position of a football or soccer ball as it is kicked in standard play. A spring-powered swing arm and a kicking shoe propel the ball in a trajectory and with a force corresponding to a normally kicked ball. The spring which powers the swing arm can be readily wound by the user, to a desired force, and a trigger release mechanism allows the user to actuate the kicking action at the desired time. The device is readily portable and may optionally be provided with wheels. A safety lock for the swing arm and safety guards for the moving parts provide safety for the users. One or more players being trained to defend against kicked balls, or to react to kicked balls as offensive players, can be positioned and prepared as desired, and the kicking action actuated reproducibly, as often and as many times as desired.

Components that are optionally removable and replaceable, to provide for differing functional characteristics of the device, include the swing arm, the kicking shoe, the ball holder ("T"-plate) and the torsion spring.

It is therefore a general object of this invention to provide a training aid in the form of a device which projects a football or a soccer ball from a height and with a trajectory and force corresponding to a ball kicked by a player.

A further object of this invention is to provide a training aid, as aforesaid, which projects a football, or optionally a soccer ball, as often and as many times as desired for training, without the involvement of a player as kicker.

Still another object of this invention is to provide a training aid, as aforesaid, which projects a football, or optionally a soccer ball, in a reproducible trajectory and with reproducible force.

Still another object of this invention is to provide a training aid, as aforesaid, which projects a football, or optionally a soccer ball, with reproducible force, which force can be varied by the user by the use of replaceable components.

Still another object of this invention is to provide a training aid, as aforesaid, which is readily portable and readily operated, and which does not require an external power source other than the user.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
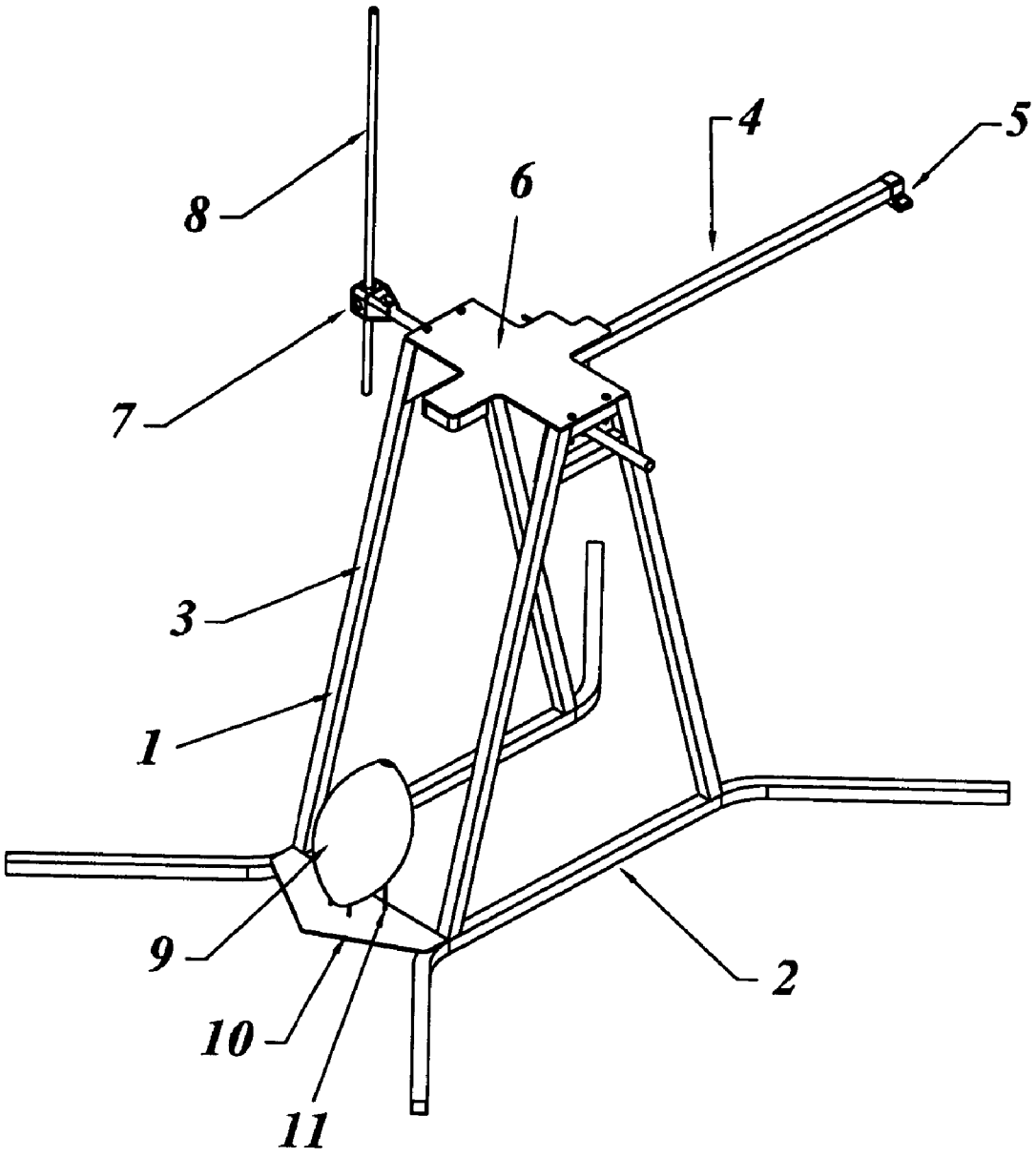
FIG. 1 is a perspective view showing the claimed device, with a standard football in place.

Turning more particularly to the drawings, FIG. 1 shows the training device 1 having a horizontal base frame 2, vertical A-frame support 3, swing arm 4, kicking shoe, 5, top plate 6, crank hub 7, and loading crank 8.

FIG. 1 also shows the standard football 9 resting on a ball support ("T" plate) 10, having football support rods 11.

Figure 2:
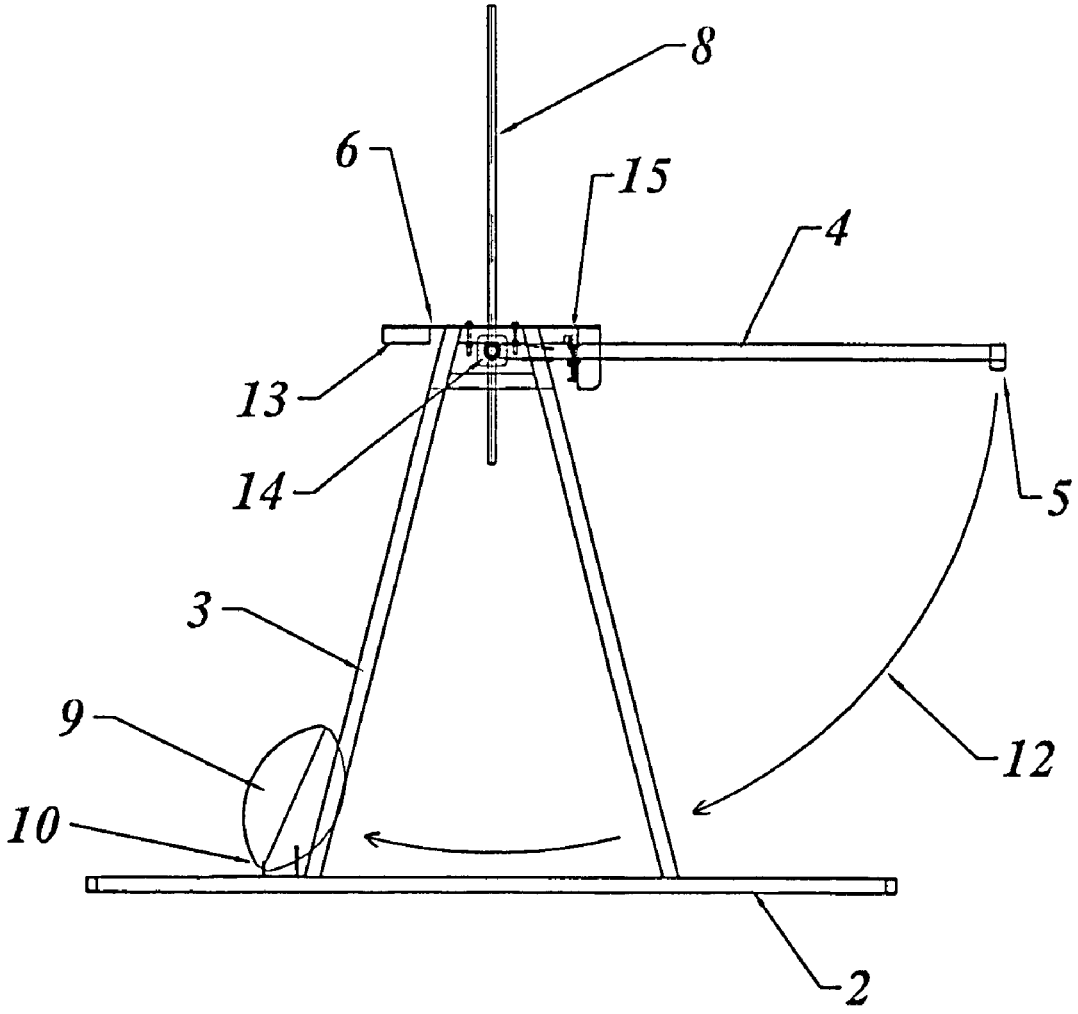
FIG. 2 is a side view showing the swing arc of the swing arm and kicking shoe.

FIG. 2 shows the swing arc 12 of the swing arm 4 and kicking shoe 5, rubber bumping pad 13, torsion spring 14, and release mechanism 15.

Figure 3:
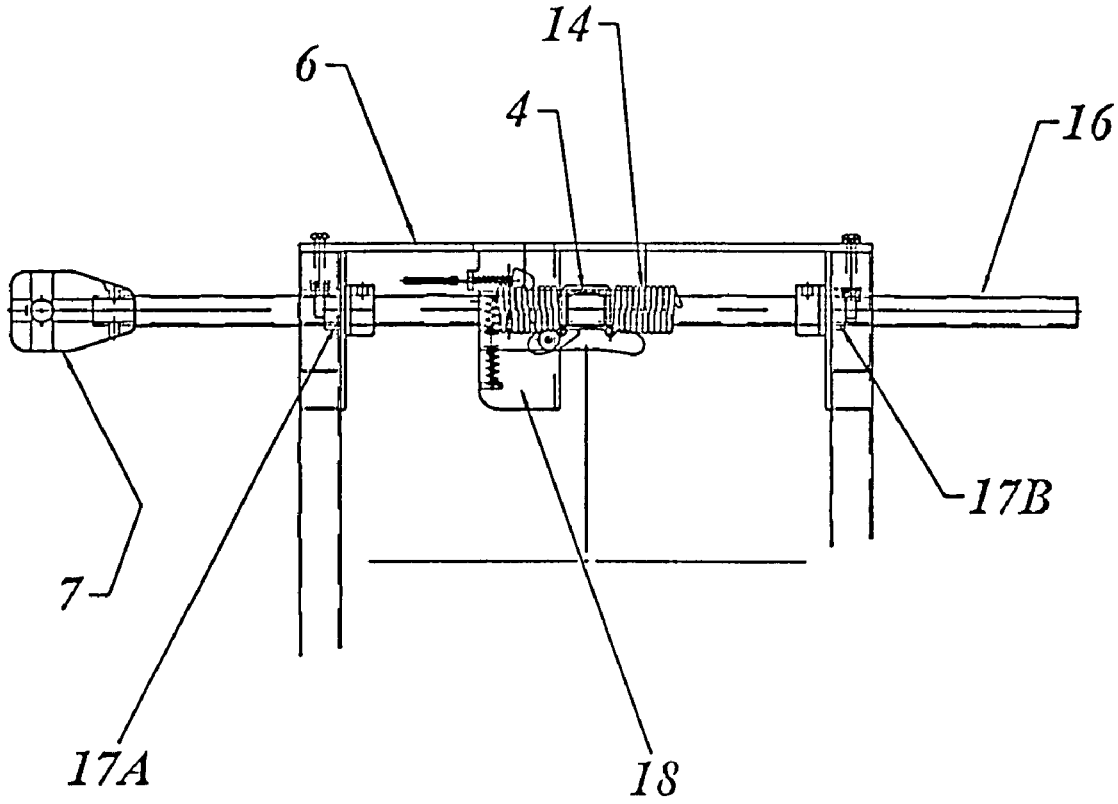
FIG. 3 is a cutaway view showing the spring mechanism and associated components.

FIG. 3 shows the swing arm shaft 16, swing arm shaft bearings 17A and 17B, torsion spring 14 and trigger plate 18 of the first release mechanism.

Figure 4:
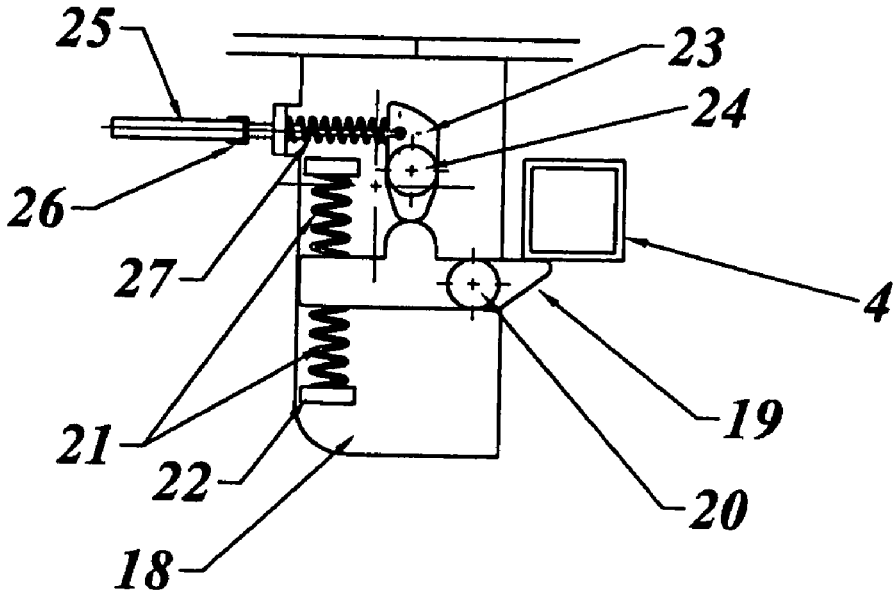
FIG. 4 is a cutaway view showing a first release mechanism, having a trigger release operated by a flexible cable.

FIG. 4 shows the first release mechanism, having a trigger plate 18, swing arm latch 19, swing arm latch pivot 20, swing arm latch centering springs 21, centering spring mount 22, latch trigger 23, latch trigger pivot 24, flexible cable 25, cable adjuster 26 and cable return spring 27.

Figure 5:
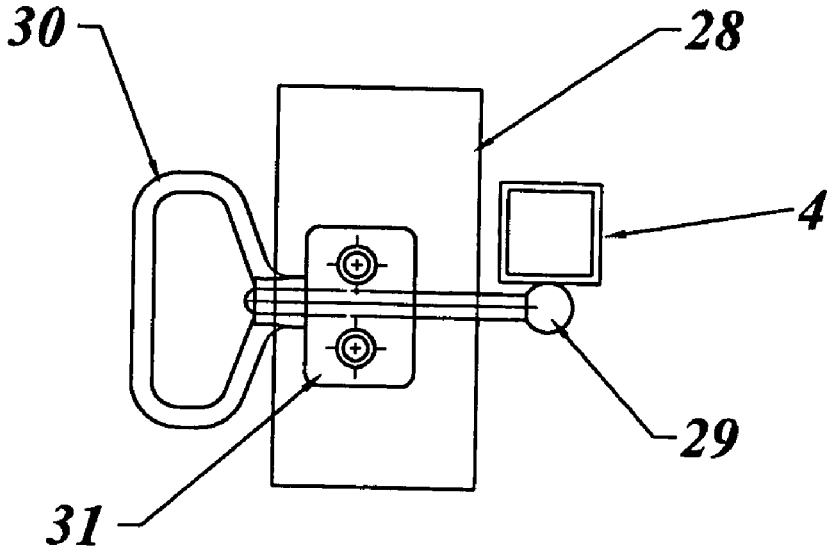
FIG. 5 is a cutaway view of a second release mechanism, having a ball release operated by a push/pull ring.

FIG. 5 shows the second release mechanism, having a trigger plate 28, swing arm ball release 29, push/pull ring handle 30 and ball release mount block 31.

Figure 6:
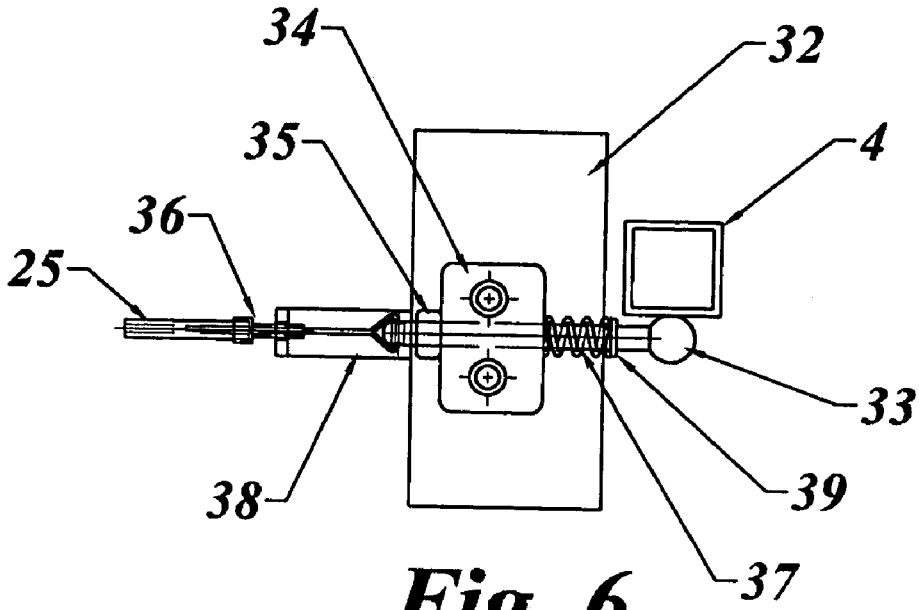
FIG. 6 is a cutaway view of a third release mechanism, having a ball release operated by a flexible cable.

FIG. 6 shows the third release mechanism, having a trigger plate 32, swing arm ball release 33, ball release mount block 34, ball release stop 35, flexible cable 25, cable adjuster 36, ball release return spring 37, flexible cable mount 38 and return spring retainer clip 39.

Figure 7:
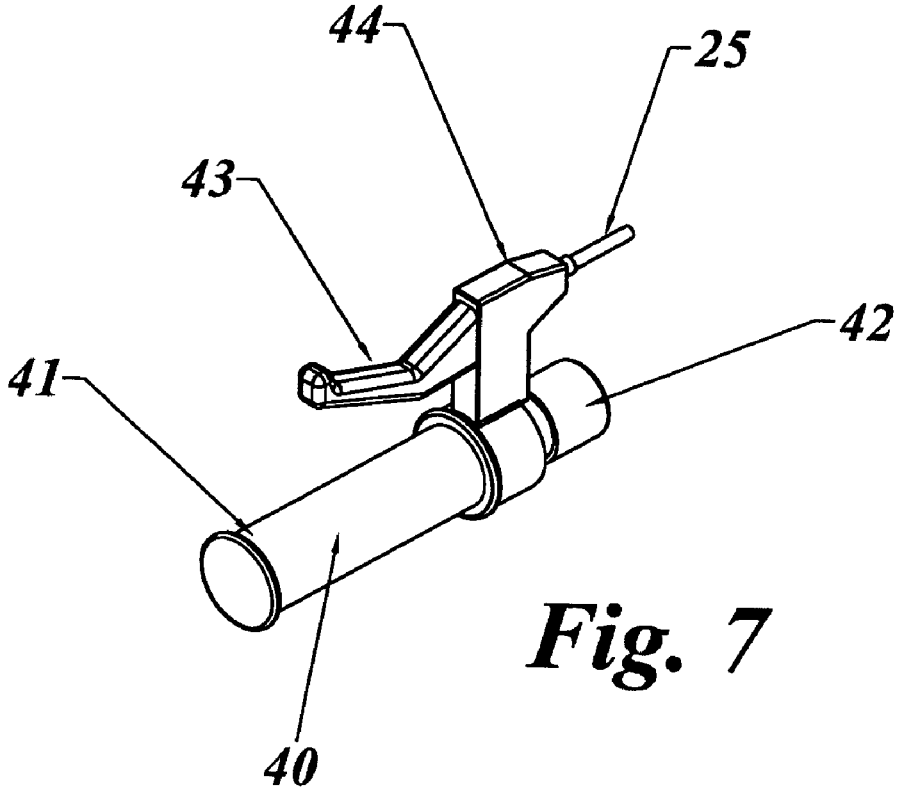
FIG. 7 is a perspective view of the trigger release handle, having a flexible cable for use with the first and third release mechanisms.

FIG. 7 shows the trigger release handle 40, having a handle grip 41, protective end cap 42, brake lever 43, brake lever housing 44 and flexible cable 25.

The trigger release handle 40 may be a modified bicycle brake control device, or similar commercially available device modified to provide flexible cable control.

An optional safety lock for the swing arm and optional safety guards for the moving parts would provide increased safety for the users.

The kicking shoe 5 is optionally replaceable, having a strong pin and collar, or similar, construction. Alternate replaceable kicking shoes may vary in the angle of contact with the ball, or in other features affecting the ball trajectory.

The swing arm 4 optionally is comprised of two parts, which can be readily separated, so that the distal part can be removed and replaced with an alternate distal part, so that the distance and angle of the kicking shoe with regard to the swing arm shaft may be varied. The two parts of the swing arm are joined by a strong pin and collar, or similar, construction.

The ball support ("T"-plate) 10 is optionally removable and replaceable with an alternate ball support, so that support pins may be varied in height and placement to provide varied ball positions for footballs or soccer balls.

The torsion spring 14 is optionally removeable and replaceable with an alternate torsion spring of different spring strength, so that the kicking force and trajectory may be varied.

The loading and release of the torsion spring 14 is accomplished by the user as a single cocking action followed by a single trigger action, having a single force.

The material of the device is preferably steel, except as otherwise described.

The torsion spring 14, centering springs, cable return springs, and ball release return spring are preferably of spring steel.

The bumping pad 13 is preferably of rubber or any resilient elastomeric material.

The optional safety guards may be of steel mesh, Nylon (R) mesh or other elastomeric polymer material.

The base frame 2 may optionally have two or four attached wheels, by which the device may be moved when tipped, but which do not contact the ground when the device is upright.

The frame components, 2 and 3, and optional wheels may be of high-impact elastomeric polymer or composite material.

It is to be understood that while certain forms of this invention have been illustrated and described, it is not limited thereto except insofar as such limitations are included in the following claims and allowable functional equivalents thereof.

In operation the device is positioned by the user at a desired location; the loading crank is rotated by the user to fully cock the swing arm; the safety catch is engaged; the desired football or soccer ball is placed in the desired position on the ball support; the players are positioned and prepared as desired; the desired signal is given to the players by the user and the kicking action is initiated by the user with the release mechanism, which may be by squeezing a cable release lever or directly pulling a push/pull release handle.

The trigger release handle, which may be used with the first or third release mechanisms, provides convenience, accurate control of timing and choice of position of the user with respect to the players, due to the variable length of the flexible cable.

Having thus described the invention, what is claimed as new and desired to be secured by Letters Patent is as follows:

1. A football and soccer kicking training aid comprising in combination a horizontal base frame, having a support for a ball, which may be a football or soccer ball;

a substantially vertical support frame;

a top assembly having a swing arm having a first and second end, said first end being attached to a swing arm shaft and said second end having a kicking shoe attached;

said swing arm shaft having a first and second end, said first end having a swing arm shaft hub attached and said first and second swing arm shaft ends being supported by first and second bearings affixed in a top plate of said top assembly;

a torsion spring having a first and second end, said first spring end being attached to said swing arm shaft, and said second spring end being attached to said top plate, so that rotation of said swing arm shaft in one direction by said swing arm shaft hub increases the torsion of said torsion spring;

a swing arm shaft loading crank attached to said swing arm shaft hub, so that said swing arm second end may be raised to a substantially horizontal position;

restraining and releasing mechanism attached to said top plate for restraining said swing arm in a substantially horizontal position, and for releasing said restraint, to allow said torsion spring to move said second end of said swing arm in a downward arc, so that said kicking shoe moves towards said ball support and would strike a football or soccer ball supported by said ball support.

2. A device of claim 1, wherein said support for the ball is removable and replaceable, so that the support is specially designed and arranged to support a football or a soccer ball, and wherein the support enables the ball to be impacted in a desired trajectory by said kicking shoe.

3. A device of claim 1, wherein said swing arm has a first and second part, said first part including said first swing arm end and said second part including said second swing arm end, said first and second parts being readily separated and rejoined, and said second part having alternate counterparts having different lengths.

4. A device of claim 1, wherein said kicking shoe is removeable and replaceable, said kicking shoe having alternate counterparts having different lengths and different angles of the kicking shoe with regard to the kicking arm shaft.

5. A device of claim 1, wherein said torsion spring is removeable and replaceable, said torsion spring having alternate counterparts having different spring torsion strengths.

6. A device of claim 1, wherein said restraining and releasing mechanism is a latch and trigger component, wherein said latch and trigger are connected by a flexible cable.

7. A device of claim 1, wherein said restraining and releasing mechanism is a release ball and handle component.

8. A device of claim 1, wherein said swing arm second end may be held in a substantially horizontal position by a safety catch after said torsion spring is loaded, said safety catch preventing release by said restraining and releasing mechanism.

9. A device of claim 1, wherein safety guards are attached to said substantially vertical support frame, to protect users and players from moving parts of the device.

10. A device of claim 8, wherein safety guards are attached to said substantially vertical support frame, to protect users and players from moving parts of the device and wherein said restraining and releasing mechanism is a latch and trigger component, wherein said latch and trigger are connected by a flexible cable.

11. A device of claim 10, wherein said ball support is removable and replaceable, so that support elements specifically designed and arranged to support footballs or soccer balls enable a desired trajectory of said balls as a result of impact of said kicking shoe.

12. A device of claim 11, wherein said kicking shoe is removeable and replaceable, said kicking shoe having alternate counterparts having different lengths and different angles of the kicking shoe with regard to the swing arm shaft.

13. A device of claim 12, wherein said torsion spring is removeable and replaceable, said torsion spring having alternate counterparts having different spring torsion strengths.

14. A device of claim 8, wherein safety guards are attached to said substantially vertical support frame, to protect users and players from moving parts of the device and wherein said restraining and releasing mechanism is a release ball and handle component.

15. A device of claim 14, wherein said support for the ball is removable and replaceable, so that the support is specially designed and arranged to support a football or a soccer ball, and wherein the support enables the ball to be impacted in a desired trajectory by said kicking shoe.

16. A device of claim 15, wherein said kicking shoe is removeable and replaceable, said kicking shoe having alternate counterparts having different lengths and different angles of the kicking shoe with regard to the swing arm shaft.

17. A device of claim 16, wherein said torsion spring is removeable and replaceable, said torsion spring having alternate counterparts having different spring torsion strengths.

* * * * *